US006101670A

United States Patent [19]

Song

[11] Patent Number: 6,101,670

[45] Date of Patent: Aug. 15, 2000

[54] DUST COLLECTION TESTER FOR A VACUUM CLEANER

[76] Inventor: Young-So Song, 5-103 Kaepo 1-Cha Woosung Apt., 503 Daechi 1-Dong, Kangnam-gu, Seoul, Rep. of Korea

[21] Appl. No.: 09/255,855

[22] Filed: Feb. 23, 1999

[30] Foreign Application Priority Data

Dec. 31, 1998 [KR] Rep. of Korea ..... 98-28526 U

[51] Int. Cl.[7] ..... A47L 9/00

[52] U.S. Cl. ..... 15/339; 15/347

[58] Field of Search ..... 15/339, 347; 55/486, 55/487, 503

[56] References Cited

U.S. PATENT DOCUMENTS

| | | | |
|---|---|---|---|
| 2,293,920 | 8/1942 | Replogle | 15/339 |
| 2,351,068 | 6/1944 | Replogle | 15/339 |
| 2,353,621 | 7/1944 | Replogle | 15/339 |
| 2,759,228 | 8/1956 | Gordon | 55/503 |
| 2,766,844 | 10/1956 | Humphrey | 55/503 |
| 4,825,502 | 5/1989 | Armstrong et al. | 15/339 |

*Primary Examiner*—Theresa T. Snider
*Attorney, Agent, or Firm*—Bacon & Thomas, PLLC

[57] ABSTRACT

A dust collection tester of a vacuum cleaner for conveniently cleaning by vacuum absorption floors, carpets, sofas, etc., which makes it possible to visually confirm dust collection force of the vacuum cleaner and dust collection states according to absorption force of the vacuum cleaner, and includes a lower body formed with a transparent material and having a hinge part at one side, a locking part at the other side, and an insertion part formed with grooves to be inserted into the insertion opening portion of the vacuum cleaner by locking the protrusion of the opening portion of the vacuum cleaner in the grooves of the insertion part of the lower body, and an upper body formed with a transparent material and symmetrically to the lower body and having a hinge part at one side, a locking piece at the other side, and a dust collection conduit, wherein the hinge parts of the lower body and the upper body are connected by a hinge pin, and the locking part of the lower body is coupled with the locking piece of the upper body.

10 Claims, 4 Drawing Sheets

FIG. 1
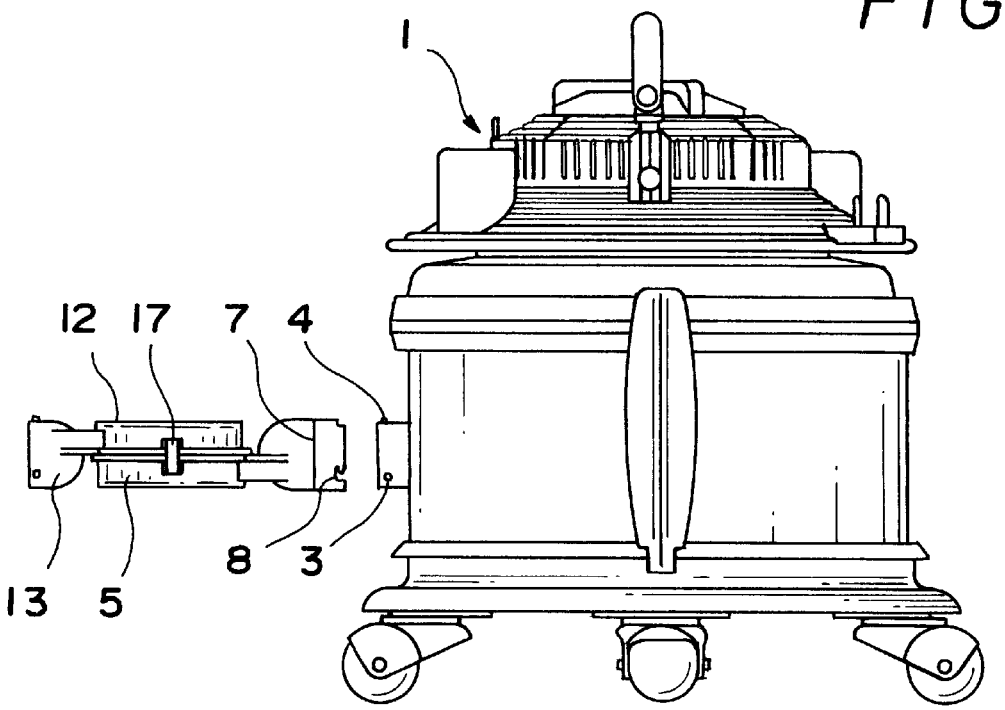
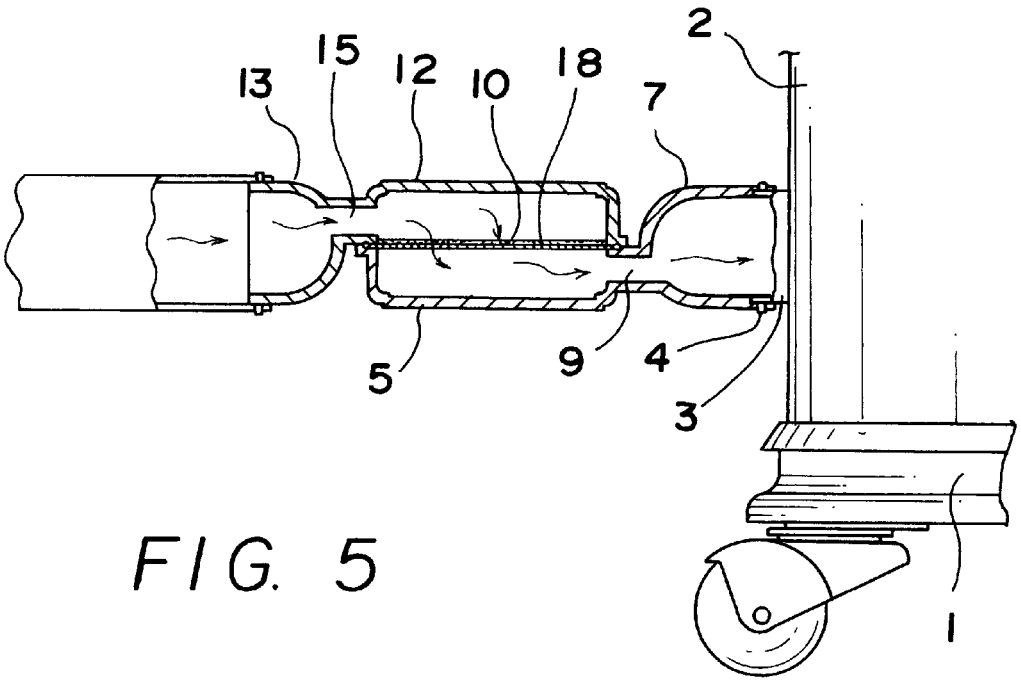
FIG. 5

DUST COLLECTION TESTER FOR A VACUUM CLEANER

BACKGROUND OF THE INVENTION

1. Field of the Invention

The present invention relates to a dust collection tester of a vacuum cleaner for conveniently cleaning by vacuum absorption floors, carpets, sofas, etc., which makes it possible to visually confirm dust collection force of the vacuum cleaner and dust collection states according to absorption force of the vacuum cleaner.

2. Description of the Conventional Art

In general, a vacuum cleaner includes a dust collection member, a motor for generating vacuum in a main body of the cleaner and a filter. The dust collection member is mounted at one side of the cleaner and connected to an absorption member, which is connected to a flexible tube. The absorption member is selectively provided with a brush or, other cleaning accessories so that cleaning is carried out by absorbing dust or other pollutant through the brush or accessories.

In the cleaner, the absorbing member has an end part which is connected with the flexible tube and the other end which is connected with a connection member the accessories. The connection member is formed with an insertion part in the shape of a tube, so that the insertion part of the connection member is inserted by an accessory from the front end of the insertion part by pressing the accessory.

In the vacuum cleaner, the most important function is the dust-collection force. In spite of this fact, the conventional vacuum cleaner has a disadvantage in that there has been no equipment to measure the dust-collection force of the vacuum cleaner by visual inspection, and the absorption force is simply regarded as the dust-collection force.

On the other hand, the conventional vacuum cleaner has another disadvantage that the absorption force becomes weaker when the filter, which is installed in a dust collection box, becomes clogged. In this case, even though it is easily checked that the dust collection force becomes reduced relative to the absorption force, it is still difficult to actually measure the dust collection force of the vacuum cleaner. Further, filters are usually changed one after another after a predetermined time lapses.

SUMMARY OF THE INVENTION

The present invention overcomes the disadvantages of the conventional vacuum designs and it is an object of the present invention to provide a dust collection tester for a vacuum cleaner that can or conveniently clean by vacuum absorption, floors, carpets, sofas, etc., and which makes it possible to visually confirm that the dust collection force of the vacuum cleaner and the dust collection states according to absorption force of the vacuum cleaner.

In order to achieve the above objects of the present invention, a dust collection tester to be coupled with a vacuum cleaner, in which a dust collection member having a vacuum motor and a filter is installed in a main body and formed with an insertion opening portion having protrusions at one side of the main body. The device includes a lower body formed with a transparent material and having a hinge part at one side, a locking part at the other side, and an insertion part formed with grooves to be inserted into the insertion opening portion of the vacuum cleaner by locking the protrusion of the opening portion of the vacuum cleaner in the grooves of the insertion part of the lower body, and an upper body formed with a transparent material and symmetrically to the lower body and having a hinge part at one side, a locking piece at the other side, and a dust collection hole, wherein the hinge parts of the lower body and the upper body are connected by a hinge pin, and the locking part of the lower body is coupled with the locking piece of the upper body, such that the lower body and the upper body are coupled together.

BRIEF DESCRIPTION OF THE DRAWINGS

The present invention will become better understood from the detailed description given herein with reference to the accompanying drawings which are given by way of illustration only, and thus are not limited of the present invention, and wherein:

FIG. 1 is a schematic view of a dust collection tester according to an embodiment of the present invention with a main body of a cleaner;

FIG. 5 is a plane view for showing the dust collection tester, which is assembled into the cleaner main body.

DETAILED DESCRIPTION OF THE INVENTION

Figure 2:
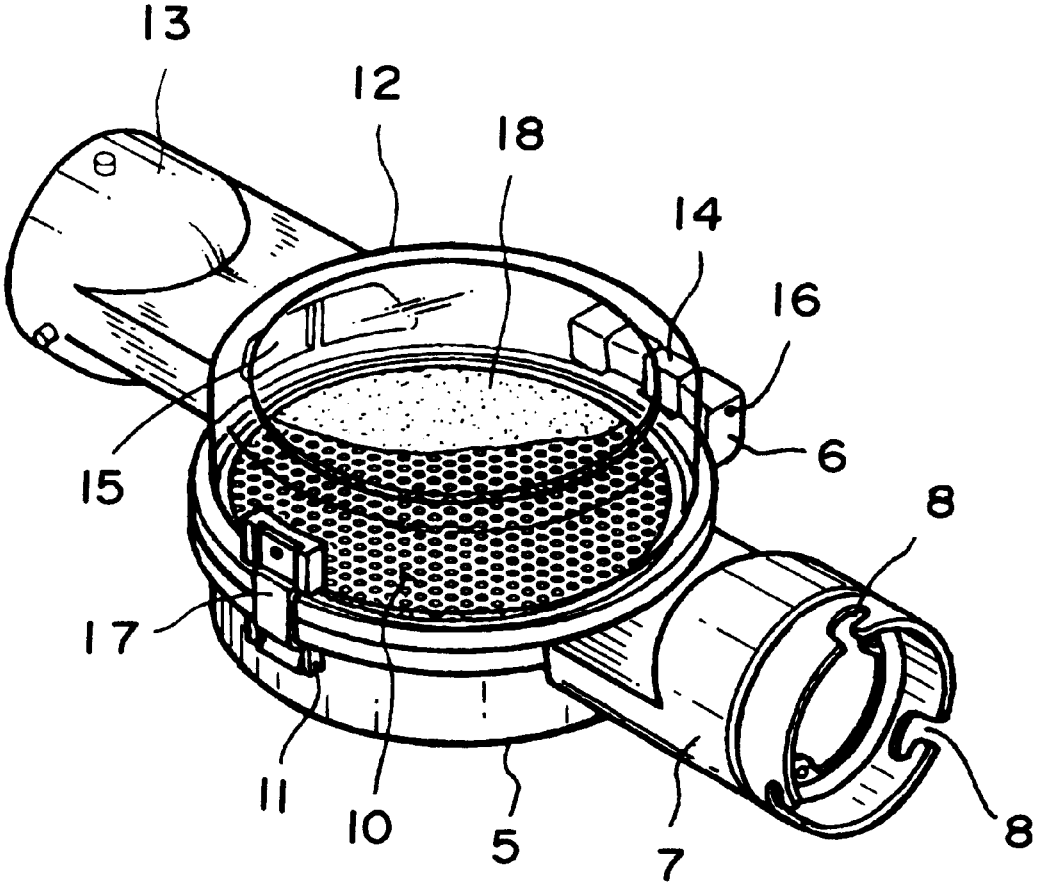
FIG. 2 is a schematic perspective view detailing the assembly of the dust collection tester of FIG. 1.

A dust collection tester for a vacuum cleaner according to preferred embodiments of the present invention would be explained in detail herein with reference to the accompanying drawings.

A vacuum cleaner includes a dust collection member connected to a vacuum motor and a filter, the cleaner having a dust collection box 2 in a main body 1. The vacuum cleaner includes an insertion-opening portion 3 having protrusions 4 extending from one side of the main body 1.

A dust collection tester includes a lower body 5 formed with transparent material and having a hinge part 6 at one side, a locking art 11 at the other side, a dust collection conduit 9, and an insertion part 7 formed with grooves 8, such that the insertion part 1 can be inserted into the insertion opening portion 3 of the vacuum cleaner by locking the protrusion 4 of the insertion opening portion 3 of the vacuum cleaner in the grooves 8 of the insertion part 7 of the lower body 5.

The dust collection tester includes an upper body 12 formed with a transparent material and substantially symmetrical to the lower body 5. The upper body 12 includes an insertion part 13 provided with locking grooves, a hinge part 14 at one side, a locking piece 17 at the other side, and a dust collection conduit 15.

The hinge part 6 of the lower body 5 and the other hinge part 14 of the upper body 12 are connected by the hinge pin 16, and the locking part 11 of the lower body 5 is coupled with the locking piece 17 of the upper body 12, thereby the lower body 5 and the upper body 12 are coupled together.

Figure 3:
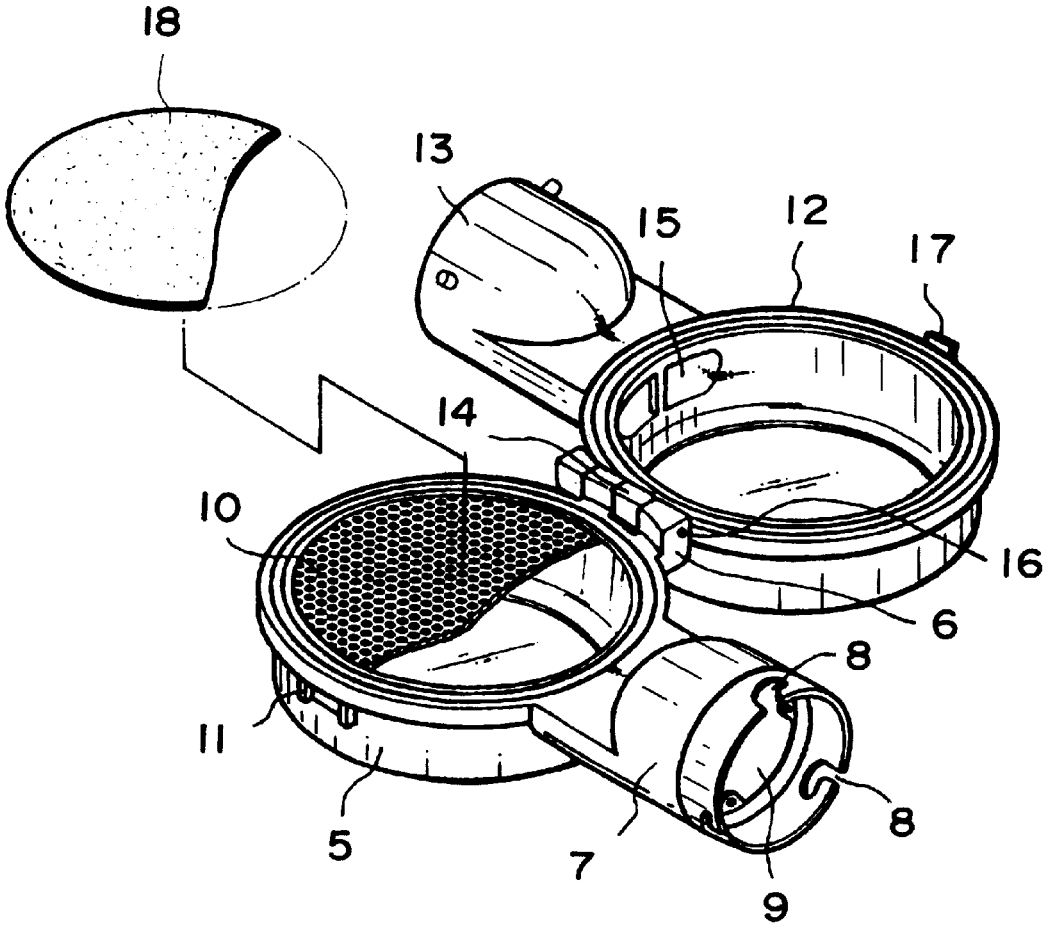
FIG. 3 is a schematic perspective view of the dust collection tester of FIG. 2, in which the tester is opened.
Figure 4:
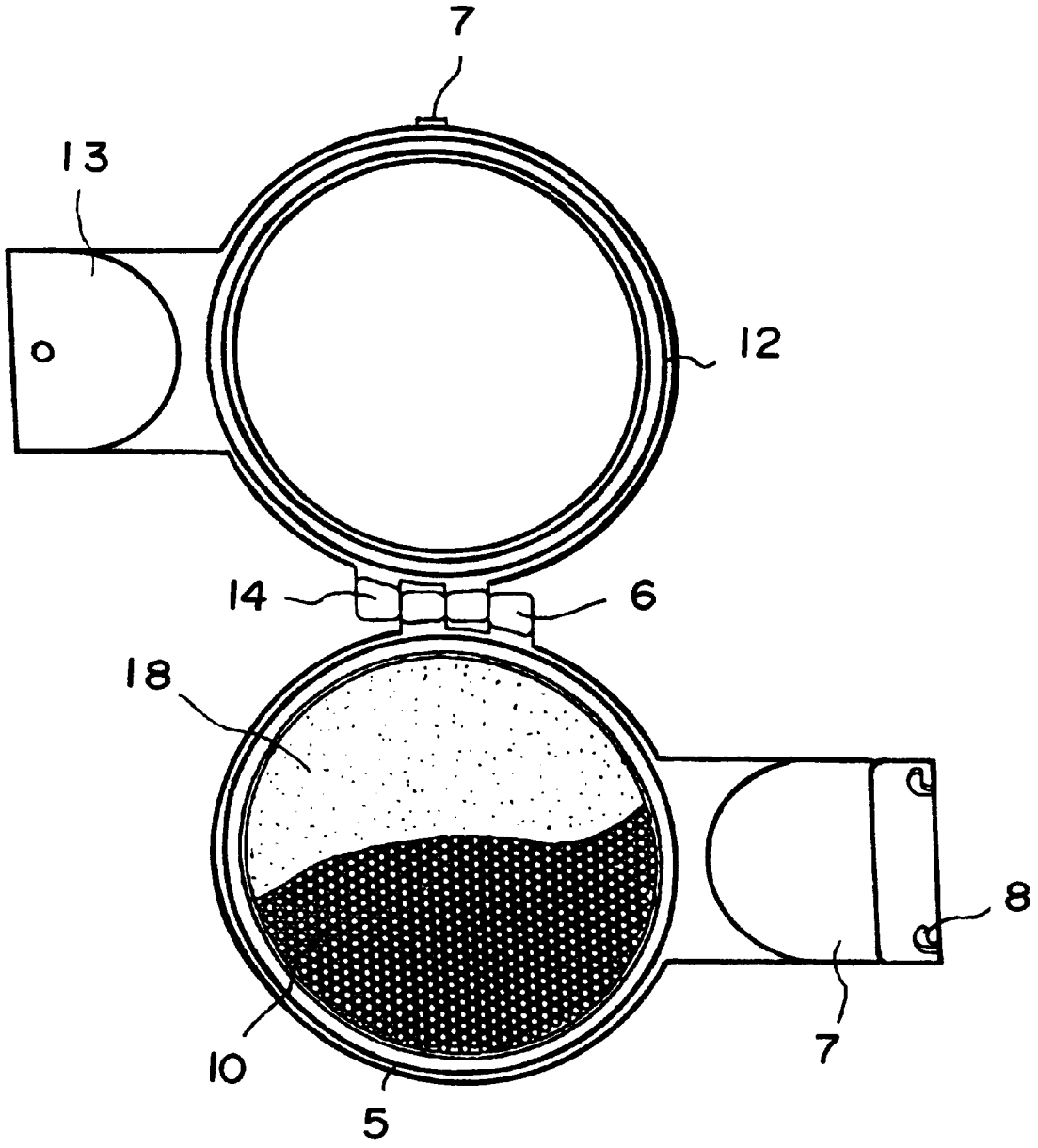
FIG. 4 is a top plan view of the dust collection tester of FIG. 3.

All of the lower body 5 and the upper body 12, need not be formed with transparent material except for portions that would permit a user to externally to see through the transparent portions to view a dust collection net 10 and a filter 18. Also, even though the lower body 5 and the upper body 12 are in the shape of circle in FIG. 1 to FIG. 5, the present invention is not limited thereto but any modification, for example, square, pentagon etc. may be made.

According to the present invention as described above, the lower body 5 and the upper body 12 are preferably formed of transparent materials and provided with the hinge parts 6, 14, the insertion parts 7, 13 respectively having grooves 8, and the dust collection conduits 9, 15 symmetrically in pairs, so that the lower and upper bodies 5, 12 can be formed with only one metallic mold and coupled together facing each other to compose a tester. The lower and upper bodies 5, 12 are opened and/or closed by the hinge pin 16 installed on the hinge parts 6, 14. The lower body 5 is provided with the dust collection net 10 on which to place the filter 18, and the locking part 11, and the locking piece 17 (formed on the upper body 12) is locked in the locking part 11 of the lower body 5, thereby finishing the assembly of the dust collection tester.

When the dust collection tester is assembled, the dust collection member is installed in the main body 1 of the vacuum cleaner, which includes to the vacuum motor and the filter, and the dust collection box 2 is installed in the dust collection member. The insertion opening part 3 which is formed at one side of the dust collection box 2, is, connected to by the insertion part 7 of the lower body 5. After the grooves 8 of the insertion part 7 are inserted with the protrusions 4 of the insertion opening part 3, the insertion part 7 of the lower body 5 is turned slightly so that the protrusions 4 of the insertion opening part 3 are caught in the grooves 8 of the insertion part 7, thereby the dust collection tester is stably connected to the main body 1 of the vacuum cleaner.

If the vacuum cleaner is operating in the above state, dust and other contaminants that are collected through the absorption conduit of the vacuum cleaner are introduced to the dust collection box 2. The dust and contaminants pass through the insertion-opening portion the dust collection conduit 9 and lie on the dust collection net 10 and the filter 18. Therefore, it becomes possible to visually gage the amounts of dust that are collected on the filter 18 (dust collection state) and thereby determine the dust collection force, by seeing through the transparent upper body of the dust collection tester.

As described hereinabove, in the dust collection tester according to the present invention, since the lower and upper bodies are preferably formed with only one metallic mold and the bodies are able to be coupled together facing each other to compose a tester, the manufacturing and assembly of the tester is economical and relatively easy. Furthermore, some of the dust and contaminants absorbed through the vacuum cleaner lie on the dust collection net and the filter in the dust collection tester, so that it is possible to easily check visually of the dust collection state and the dust collection force by viewing the transparent upper body of the dust collection tester.

Although the preferred embodiments of the present invention have been disclosed for illustrative purposes, those skilled in the art will appreciate that various modifications, additions and substitutions are possible, without departing from the scope and spirit of the invention as described in the accompanying claims.

The present invention is by no means restricted to the above described preferred, but covers all variations that might be implemented by using equivalent functional elements or devices that would be apparent to a person skilled in the art, or modifications that fall within the spirit and scope of the appended claims.

What is claimed is:

1. A dust collection tester connectable to a vacuum cleaner, comprising:

an upper body including a first cavity and a first conduit, the first conduit in communication with the first cavity and the first conduit connectable to cleaning attachments associated with a vacuum cleaner;

a lower body including a second cavity and a second conduit, the second conduit in communication with the second cavity and connectable to a suction inlet of a vacuum cleaner;

a hinge device configured to hinge together the upper and lower bodies;

a locking device to detachably lock the upper and lower bodies such that the respective cavities of the upper and lower bodies are enclosed;

a filter having upper and lower surfaces, the filter secured between the first and second cavities, and the first conduit is above the upper surface thereof and the second conduit is below the lower surface thereof;

and wherein the upper and/or lower bodies includes one or more transparent body surfaces configured such that accumulation of dust on the upper or lower surfaces of the filter is visible to a user.

2. A dust collection tester as recited in claim 1, wherein the upper and lower bodies are symmetrical.

3. A dust collection tester as recited in claim 2, wherein the upper and lower bodies are formed from a single mold.

4. A dust collection tester as recited in claim 1, wherein the upper and lower bodies are entirely transparent.

5. A dust collection tester as recited in claim 1, further comprising a dust collection net on which the filter is secured.

6. A dust collection tester as recited in claim 1, wherein the upper body includes a first insertion part that is in communication with the first cavity through the first conduit and the lower body includes a second insertion part that is in communication with the second cavity through the second conduit.

7. A dust collection tester as recited in claim 6, wherein the insertion parts are attachable to external members by interlocking devices in which grooves interlock with protrusions that may be arranged on either the insertion parts or the external members.

8. A dust collection tester as recited in claim 1, wherein the hinge device includes a hinge pin.

9. A dust collection tester as recited in claim 1, wherein the locking device connects a locking part attached to the lower body and a locking piece attached to the upper body.

10. A dust collection tester as recited in claim 1, wherein the cleaning attachments associated with a vacuum cleaner include a brush.

* * * * *

US006101670C1

(12) EX PARTE REEXAMINATION CERTIFICATE (5157th)

United States Patent

Song

(10) Number: US 6,101,670 C1

(45) Certificate Issued: Jul. 19, 2005

(54) DUST COLLECTION TESTER FOR A VACUUM CLEANER

(75) Inventor: Young-So Song, 5-103 Kaepo 1-Cha Woosung Apt., 503 Daechi 1-Dong, Kangnam-gu, Seoul (KR)

(73) Assignee: Young-So Song, Seoul (KR)

Reexamination Request:
No. 90/006,631, May 12, 2003

Reexamination Certificate for:

| | |
|---|---|
| Patent No.: | **6,101,670** |
| Issued: | **Aug. 15, 2000** |
| Appl. No.: | **09/255,855** |
| Filed: | **Feb. 23, 1999** |

(30) Foreign Application Priority Data

Dec. 31, 1998 (KR) ..... 98-28526 U

(51) Int. Cl.[7] ..... A47L 9/00

(52) U.S. Cl. ..... 15/339; 15/347

(58) Field of Search ..... 15/339, 347; 55/486, 55/487, 503

(56) References Cited

PUBLICATIONS

Dustscope Instructions, 1993.

*Filter Queen News*, Feb.–Mar. 1975 issue, selected pages.

*Filter Queen News*, Winter 1978–79 issue, selected pages.

*Filter Queen News*, Summer 1978 issue, selected pages.

"How to Demonstrate the Filter Queen and Close the Sale" videotape and four selected photographs from the videotape.

A set of six Dustscope engineering drawings (#GR. R–7900, #GR. R–7901, #PG–79005, #79006, #79781, and #E. 162).

*Primary Examiner*—Terrence R. Till

(57) ABSTRACT

A dust collection tester of a vacuum cleaner for conveniently cleaning by vacuum absorption floors, carpets, sofas, etc., which makes it possible to visually confirm dust collection force of the vacuum cleaner and dust collection states according to absorption force of the vacuum cleaner, and includes a lower body formed with a transparent material and having a hinge part at one side, a locking part at the other side, and an insertion part formed with grooves to be inserted into the insertion opening portion of the vacuum cleaner by locking the protrusion of the opening portion of the vacuum cleaner in the grooves of the insertion part of the lower body, and an upper body formed with a transparent material and symmetrically to the lower body and having a hinge part at one side, a locking piece at the other side, and a dust collection conduit, wherein the hinge parts of the lower body and the upper body are connected by a hinge pin, and the locking part of the lower body is coupled with the locking piece of the upper body.

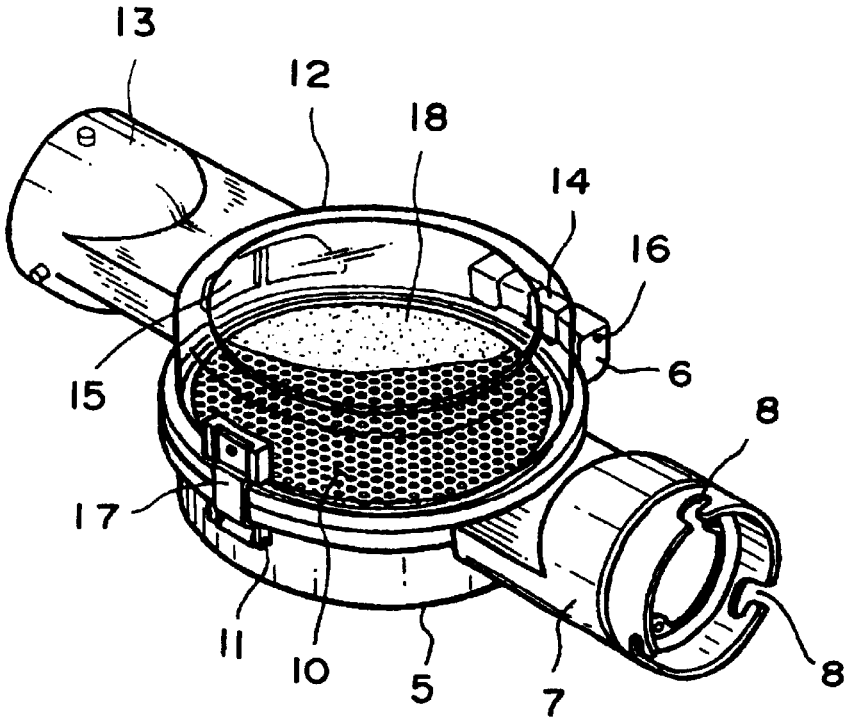

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *